US005503373A

United States Patent [19]

Schellingerhout et al.

[11] Patent Number: 5,503,373

[45] Date of Patent: Apr. 2, 1996

[54] SHAFT FURNACE

[75] Inventors: Gijsbertus Schellingerhout, Haarlem; Cornelis Slegers; Riekelt de Boer, both of Heemskerk, all of Netherlands

[73] Assignee: Hoogovens Groep BV, Ijmuiden, Netherlands

[21] Appl. No.: 337,185

[22] Filed: Nov. 7, 1994

[30] Foreign Application Priority Data

Nov. 15, 1993 [NL] Netherlands ..... 9301966

[51] Int. Cl.[6] ..... C21B 7/10

[52] U.S. Cl. ..... 266/193; 266/197

[58] Field of Search ..... 266/190, 193, 266/194, 197

[56] References Cited

U.S. PATENT DOCUMENTS

| | | | |
|---|---|---|---|
| 2,252,605 | 8/1941 | Wick, Jr. et al. | 266/193 |
| 2,252,606 | 8/1941 | Wick, Jr. | 266/193 |
| 3,953,007 | 4/1976 | Van Laar | 266/193 |

FOREIGN PATENT DOCUMENTS

| | | | |
|---|---|---|---|
| 537780 | 11/1931 | Germany . | |
| 3339734 | 3/1985 | Germany | 266/193 |
| 7312549 | 3/1975 | Netherlands . | |
| 182158 | 1/1988 | Netherlands . | |
| 1112047 | 5/1968 | United Kingdom . | |

*Primary Examiner*—Scott Kastler
*Attorney, Agent, or Firm*—Stevens, Davis, Miller & Mosher

[57] ABSTRACT

A shaft furnace, e.g. a blast furnace, has a bosh, a shaft and a mantle ring at the transition from the bosh to the shaft. At both the bosh and the shaft, there is a steel jacket and a refractory lining on the inside of the steel jacket. Cooling elements extend into the refractory lining from the steel jacket and are arranged for through-flow of cooling liquid. To provide additional cooling at the critical transition from the bosh to the shaft adjacent the mantle ring, there is at least one transition cooling element located near the mantle ring so as to cool a region of the refractory lining of the bosh adjacent the steel jacket at the transition. The transition cooling element has, as seen in plan view, a T-shape, with the cross-bar of the T-shape extending in the circumferential direction of the furnace.

5 Claims, 1 Drawing Sheet

SHAFT FURNACE

BACKGROUND OF THE INVENTION

1. Field of the Invention

The invention relates to a shaft furnace having a construction comprising a bosh and a shaft (also known as a stack) and a mantle ring (also known as a lintel) at the transition from the bosh to the shaft. This construction has a steel jacket and a refractory lining on the inside of the jacket. Cooling elements arranged for through-flow of liquid extend from the jacket into the refractory lining. An example of such a furnace is a blast furnace.

2. Description of the Prior Art

Such a furnace is known from Dutch patent application NL-A-7312549 (and corresponding U.S. Pat. No. 3,953,007). The cooling elements in the refractory lining of the furnace serve to extend the service life of the refractory lining and in this way to raise the service time of the furnace between repairs. Furnaces of the kind described above particularly furnaces of a relatively older design, are usually provided with a small number of cooling plates of small dimensions. In such furnaces a relatively thin jacket suffices. However, the design entails that the heat control in the transition zone from bosh to shaft (stack) is not optimum and leads to crack formation and leakages.

SUMMARY OF THE INVENTION

The object of the invention is now to provide a design for such a furnace so that the tendency for occurrence of crack formation and of leakages round and in the transition zone of bosh, jacket and mantle is counteracted.

The shaft furnace in accordance with the invention is characterised in that at least one transition cooling element is located near the mantle ring so as to cool-a region of the refractory lining of the bosh adjacent the steel jacket at the transition. The transition cooling element has, as seen in plan view, a shape comprising an elongate portion extending longitudinally in the circumferential direction of the furnace. For constructional reasons, preferably the transition cooling element has a T-shape in which the cross-bar of the T constitutes the elongate portion and the stem of the T extends outwardly therefrom, i.e. towards the furnace jacket.

This arrangement achieves a very effective cooling in the critical transition zone at the mantle ring and bosh, and this cooling has a favourable effect on the service life and the durability of the construction in this transition zone.

Preferably there are a plurality of the transition cooling elements arranged in a row horizontally spaced apart from each other in the circumferential direction of the furnace, and the elongate portions of said plurality of transition cooling elements are mutually spaced from each other, preferably by a short distance, e.g. less than the circumferential length of each element.

In this way cooling of the wall construction in the vicinity of said transition zone can be provided optimally, while the openings to be provided in the jacket for the cooling elements can be kept relatively small and the consequent weakening of the jacket remains limited. This is further enhanced by providing each cooling element with connections for supply and discharge of cooling liquid which are accessible on the outer side of the jacket and are somewhat at an angle relative to the steel jacket. In this connection the invention is particularly well suited to be applied in the aforementioned furnaces which are equipped with a relatively thin jacket. It is further preferred that the transition cooling elements are located in staggered positions relative to the row of cooling elements next above them.

Most suitably, the transition cooling element is above the mantle ring, and as seen in plan view, the elongate portion of said transition cooling element is at the inner periphery of the mantle ring.

The invention also consists in the cooling element as described for use in a shaft furnace.

BRIEF DESCRIPTION OF THE DRAWING

The invention will now be illustrated by a non-limitative embodiment described below with reference to the appended drawing, in which.

DESCRIPTION OF THE PREFERRED EMBODIMENT

Shaft furnaces of the kind described here are generally known in the iron and steel industry and need no further explanation.

Figure 1:
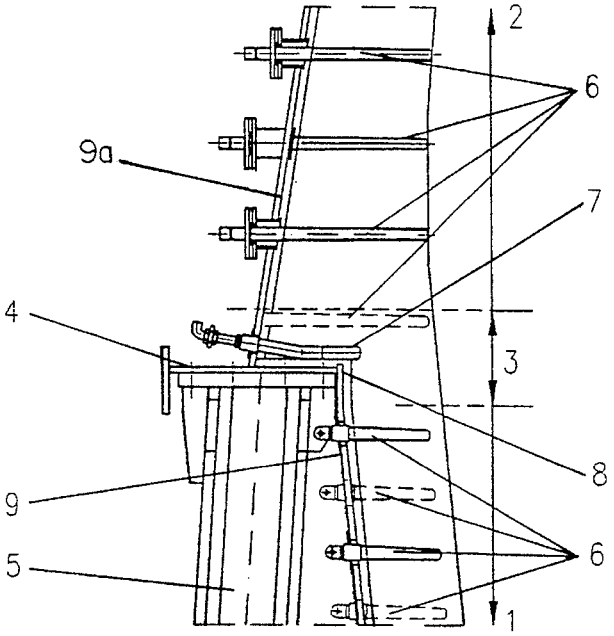
FIG. 1 shows in vertical section a part of the wall of a shaft furnace in accordance with the invention and FIG. 2 shows in horizontal section a part of the wall of the shaft furnace of FIG. 1.

In FIG. 1, there is shown an upper part of the zone 1 that constitutes the bosh of the shaft furnace, and a lower part of the zone 2 of the shaft of the shaft furnace. In the transition zone 3 located between bosh 1 and shaft 2, there is a mantle ring 4 in the form of an annular plate which is supported by a plurality of columns 5. This type of furnace is known as a column oven. It has a steel jacket 9 for the bosh and a steel jacket 9*a* for the shaft, and a refractory lining as shown interiorly of the steel jacket 9, 9*a*. In the refractory lining of the bosh 1 and the shaft 2, there are cooling plates 6 such as for example known from applicant's Dutch patent NL-182158, arranged in vertically spaced rows. Each plate 6 is mounted in the jacket 9, 9*a* and has connections exteriorly of the jacket for supply and discharge of the cooling liquid, which is typically water.

In accordance with the present invention it is now proposed to provide a row of T-shaped transition cooling elements 7 in the wall of the shaft furnace and in the vicinity of mantle ring 4. These elements project inwardly from the jacket 9 of the furnace to near the interface 8 where the refractory lining of the bosh 1 forms with the steel jacket 9. Each of these cooling elements 7 comprise a stem 10 of a relatively small section, and a cross-bar 11 which extends in the circumferential direction of the furnace. In contrast with the plates 6 which extend to near the interior face of the lining, the transition cooling elements 7 extend inwardly so that its cross-bar 11 is at a location just above the inner periphery of the mantle ring 4, to provide the desired cooling at this transition zone.

Figure 2:
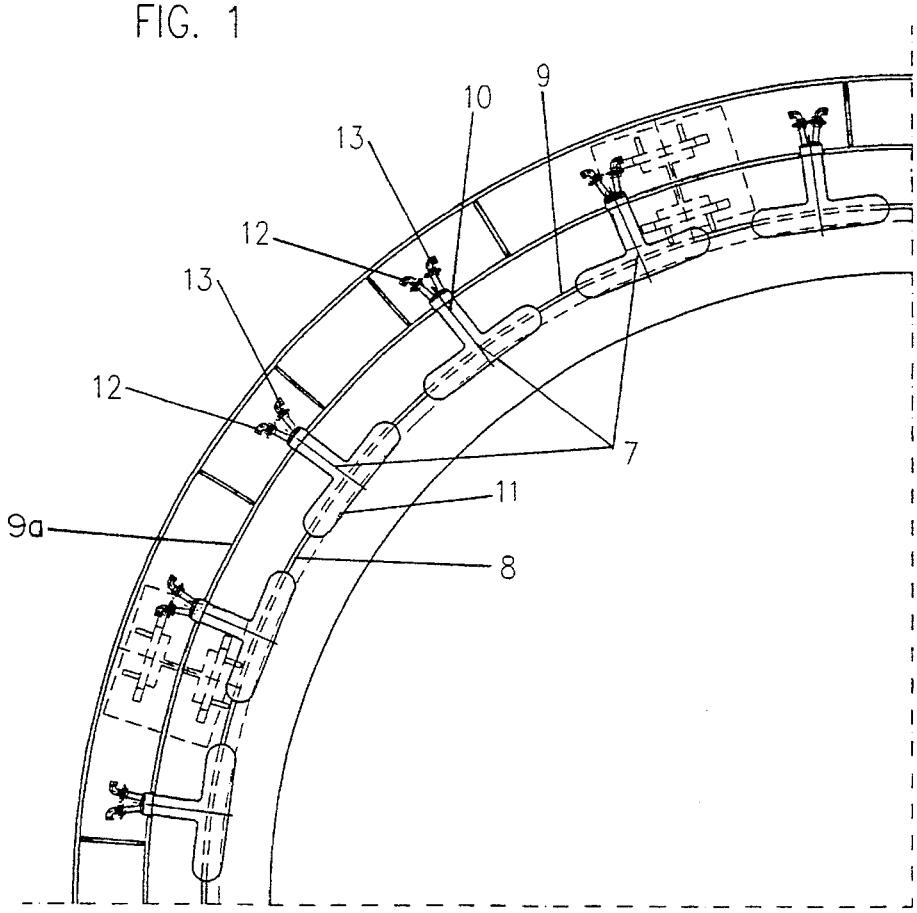

The furnace is provided with a plurality of the cooling elements 7 which are arranged in the wall of the furnace at regular intervals in the circumferential direction of the furnace, with the extremities of the cross-bars 11 positioned at short spacings from each other. In this embodiment, the cooling elements 7 are positioned in the wall of the furnace in such a way that they have a circumferentially staggered relationship, as Seen in plan view, relative to the cooling plates 6 of conventional type in the wall of the furnace in the row next above them (this row is not shown in FIG. 2). The cooling elements 7 have connections 12, 13 for supply and discharge of cooling liquid, which can flow through the cooling elements. These connections 12, 13 are accessible on the outer side of the jacket 9 and, as FIG. 2 shows, project somewhat at an angle relative to the jacket 9*a* in order to avoid difficulties in connecting.

The cooling elements 7 are copper castings, made in a conventional manner, similar to the cooling plates 6. To provide internal cooling liquid passages, there is a T-shaped vertical partition inside the element, which forms parallel inflow and outflow passages in the stem 10 and a circulation passage around the cross-bar 11 joining at its ends the inflow and outflow passages.

Instead of the T-shape shown, the cooling elements 7 may have any suitable shape providing a circumferentially elongate portion at the desired cooling location.

What is claimed is:

1. A shaft furnace having a construction comprising a bosh, a shaft and a mantle ring at the transition from the bosh to the shaft, said construction having, at both said bosh and said shaft, a steel jacket, a refractory lining on the inside of the steel jacket and a plurality of cooling elements horizontally extending in a plurality of rows into said refractory lining from said steel jacket and arranged peripherally of the refractory lining for through-flow of cooling liquid, said cooling elements including at least one row of transition cooling elements located near said mantle ring between cooling element rows of bosh and shaft at the transition from the bosh to the shaft so as to cool a region of said refractory lining of said bosh adjacent said steel jacket at said transition, each said transition cooling element having a shape comprising an elongate portion extending longitudinally in the circumferential direction of the furnace, said transition cooling elements being circumferentially staggered with respect to the position of the cooling elements immediately above them.

2. A shaft furnace according to claim 1 wherein, as seen in plan view, said transition cooling element has a T-shape having a cross-bar of the T which constitutes said elongate portion thereof and a stem of the T which extends outwardly from said cross-bar.

3. A shaft furnace according to claim 1, wherein there are a plurality of transition cooling elements and said elongate portions of said plurality of transition cooling elements are mutually spaced from each other.

4. A shaft furnace according to claim 1 wherein said row of transition cooling elements is above said mantle ring, said elongate portion of each said transition cooling element is at the inner periphery of said mantle ring.

5. A shaft furnace according to claim 1 wherein said transition cooling element has connections for supply and discharge of cooling liquid which connections are accessible at the outer side of said steel jacket and are at an angle to the furnace jacket.

* * * * *